US008687833B2

(12) United States Patent
Probst et al.

(10) Patent No.: US 8,687,833 B2
(45) Date of Patent: Apr. 1, 2014

(54) METHOD OF PROVIDING INPUT PARAMETERS OR INFORMATION FOR THE FITTING PROCESS OF HEARING INSTRUMENTS OR EAR PIECES FOR A HEARING DEVICE

(75) Inventors: Daniel Probst, Zurich (CH); Christoph Widmer, Wernetshausen (CH); Samuel Hans Martin Roth, Stafa (CH); Tobias Poetzl, Stafa (CH)

(73) Assignee: Phonak AG, Stafa (CH)

( * ) Notice: Subject to any disclaimer, the term of this patent is extended or adjusted under 35 U.S.C. 154(b) by 61 days.

(21) Appl. No.: 13/146,936

(22) PCT Filed: Mar. 30, 2009

(86) PCT No.: PCT/EP2009/053721

§ 371 (c)(1),
(2), (4) Date: Jul. 29, 2011

(87) PCT Pub. No.: WO2009/087241

PCT Pub. Date: Jul. 16, 2009

(65) Prior Publication Data

US 2012/0099748 A1 Apr. 26, 2012

(51) Int. Cl.
*H04R 25/00* (2006.01)

(52) U.S. Cl.
USPC ..... 381/322; 381/328; 381/380

(58) Field of Classification Search
USPC ..... 381/58, 60, 322, 328, 331, 370, 380, 381/312, 314, 315; 600/559
See application file for complete search history.

(56) References Cited

U.S. PATENT DOCUMENTS

| | | | | |
|---|---|---|---|---|
| 7,099,485 | B2 * | 8/2006 | Dittli | 381/322 |
| 2006/0233384 | A1 * | 10/2006 | Bachler et al. | 381/60 |
| 2008/0260193 | A1 * | 10/2008 | Westermann et al. | 381/330 |

FOREIGN PATENT DOCUMENTS

| | | | | |
|---|---|---|---|---|
| DE | 10235501 | A1 * | 10/2003 | H04R 25/00 |
| WO | 2007/045254 | A1 | 4/2007 | |

OTHER PUBLICATIONS

International Search Report for PCT/EP2009/053721 dated Nov. 2, 2009.
Written Opinion for PCT/EP2009/053721 dated Nov. 2, 2009.

* cited by examiner

*Primary Examiner* — Suhan Ni
(74) *Attorney, Agent, or Firm* — Pearne & Gordon LLP

(57) ABSTRACT

Input parameters or information for the fitting process of individually shaped or customized hearing devices and/or ear pieces of a hearing device are provided by storing fitting relevant data during the manufacturing process of an ear piece for the use with a hearing device into storage means, the data storage means being arranged at/or in the ear piece and/or a storage means kept or linked to the ear piece of the hearing device.

13 Claims, 2 Drawing Sheets

METHOD OF PROVIDING INPUT PARAMETERS OR INFORMATION FOR THE FITTING PROCESS OF HEARING INSTRUMENTS OR EAR PIECES FOR A HEARING DEVICE

The present invention refers to a method of providing input parameters or information for the fitting process of individually shaped or customized hearing devices and/or, ear pieces for a hearing device as well as to an ear piece of a hearing device.

Ear pieces are used for the acoustic and mechanical coupling of (behind the ear hearing) devices to the ear canal. They may be either entirely passive or may contain active component such as receivers, microphones etc. Usually an additional vent is used to modify the acoustic transmission. The hearing device fitter uses the parameters and the information e.g. of the vent, such as the length of the borehole, the diameter as well as other acoustic information to estimate the acoustic behaviour. These information and parameters are the basis for a good adaptation of the hearing system.

The information e.g. of the vent are very often lost before the production of the ear piece until the adjustment at the fitter or they are not being recognised, as changes for the ordered vent dimensions are sometimes only written on a delivery note. Furthermore, very often only the diameter is used as information, which is not good enough for a very good acoustic adaptation. Further information, such as the length of the vent, acoustic vent mass (AVM), length of the shell of the ear piece, design of the shell of the ear piece, design of the sound channel conducting the sound signals from the receiver to the ear canal, individual characteristics of the user of the hearing device, etc. which are also very important and which very often are available at the digital manufacturing of the ear piece shell are not transferred to the fitter as there does not exist an information path.

At an in the ear hearing device it is already possible to store the so called AVM information into the device as such and can be used for the adaptation, as the hearing device is built within the shell and therefore is firmly connected to the shell.

So far, the measures of the vent at ear pieces are exclusively given as diameter. The so called AVM information, which describes the real acoustic effect, is only used at in the ear hearing devices as mentioned above. The information regarding the name of the producers, the serial number, acoustic information to the ear piece, the length and the diameter of the vents etc. are only available in paper form, which means written on the delivery form.

As already mentioned above usually such information is lost on the way from the production to the acoustic fitter or it is not recognised by not reading the delivery form. At the design process no information is produced, which means in other words it is not available for the further fitting process. Due to the missing information, the adaptations of hearing system are qualitatively worse as they could be, if exact information about the acoustic behaviour was available.

It is therefore an object of the present invention to provide a method for estimating or defining more appropriate input parameters or information for starting the fitting process for a hearing device and/or an ear piece of a hearing device. It is a further object of the present invention to improve the manufacturing process of hearing devices, by shortening the fitting process, by providing individually adapting starting parameters and information of good quality.

The objects will be inventively solved by the present invention as set forth in the claims.

BRIEF DESCRIPTION OF THE DRAWINGS

For the purpose of facilitating an understanding of the disclosure, there is illustrated in the accompanying drawings an example embodiment thereof to be considered in connection with the following description. Thus, the disclosure may be readily understood and appreciated by FIG. 1 showing schematically a top level flow diagram of an example method of providing information for the fitting process of ear pieces and FIG. 2 showing a schematic example of a hearing device.

DETAILED DESCRIPTION

Figure 1:
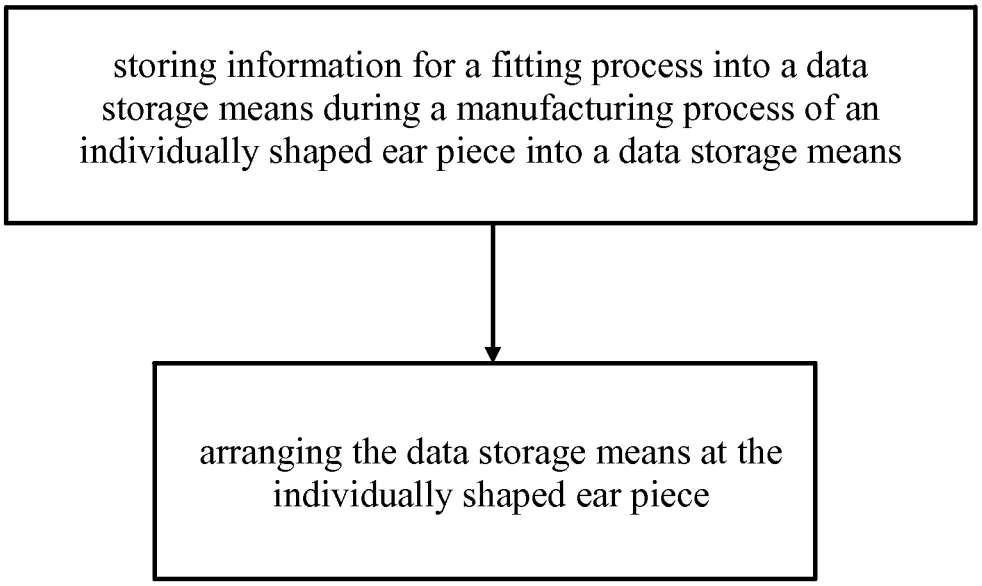

Referring to FIG. 1, the present invention provides a method of providing input parameters or information for the fitting process of individual shaped or customized hearing devices and/or ear pieces of a hearing device by storing fitting relevant data during the manufacturing process for the use of the hearing device into data storage means, the data storage means being arranged at or in the ear piece and/or at storage means kept or linked to the ear piece of the hearing device, and such data storage including but not limited to printing of information on the device and/or ear piece.

Figure 2:
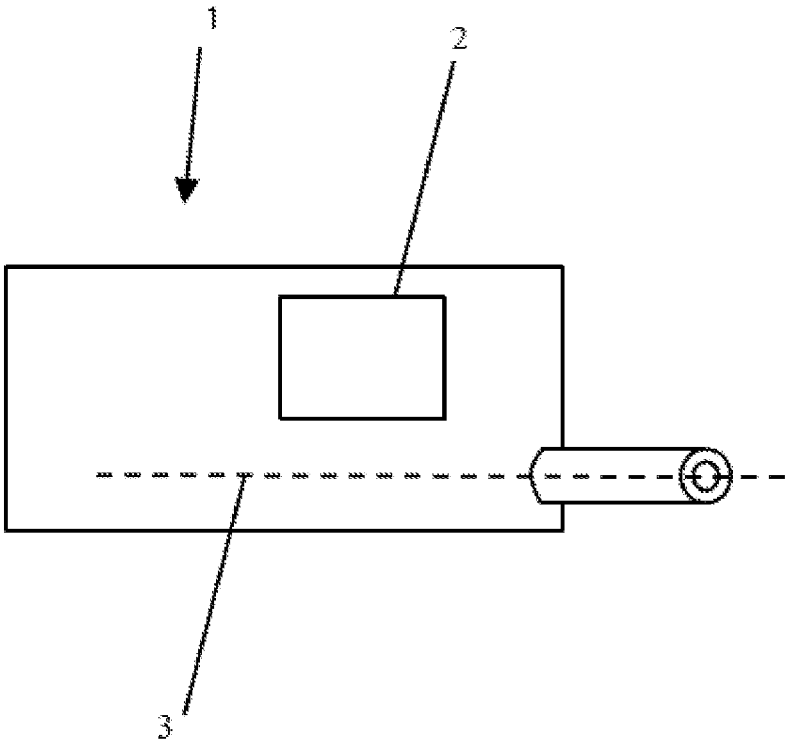

Referring to FIG. 2, a hearing device is shown including an ear piece 1, a data storage means 2, and a vent 3.

The information about the acoustic parameters of the ear piece can be written onto the ear piece which can be done e.g. by laser writing, by engraving or by label printing, by arranging a written label, by arranging a RFID label, etc. These information can be written in clear text form, e.g. by defining the diameter of the vent, acoustic vent mass, the length of the ear canal cone, the type of the ear piece, the type of the used hearing elements or other information.

By coding the information also complex information can be written on the ear piece with a relatively short code, such as e.g. a Coupling Code. By using a respective fitting software it should be possible to encode the information out of the code.

Examples for such code information on an ear piece could be e.g.:

Example 1

F2 (xShell and SlimTip with AOV)

| | |
|---|---|
| Name of Producer | PHONAK |
| Coupling Code | 123 456 |
| Serial number | 1234V568 |

Example 2

F3 (cShells with AOV)

| | |
|---|---|
| Name of Company | PHONAK |
| Coupling Code _ Type of Receiver | 123 456 P |
| Serial number | 1234V568 |

The coded information can also be written on the ear piece as bar code (1D- or 2D code).

Instead of direct writing on the ear piece acoustic or fitting parameters or the information could also be written or stored within a chip within the ear piece or on a separate storage means, at or within the ear piece shell.

Using a storage chip would enable to store further information such as the name of the user person, date of production, serial number, side on which the ear piece is used (left or right) or other information. The storage and the reading of the parameters or information could be executed e.g. wirelessly such as by induction or by radio frequency reading (RFID). The storage chip could be passive so that it is small and the information can be stored practically with an unlimited duration. At the reading process the chip can be charged inductively with energy to transmit the information.

A reading device could be connected to the programming device of the hearing device or could be integral. At low energy requirement for the reading the hearing device could be used as reading device equipped with an inductor. This would enable to select the connected ear piece together with its acoustic parameters and information not only at the fitting process at the computer but also at each starting process (booting) of the hearing device. As a result, the hearing device could recognise if a wrong or an interchanged or a new ear piece is connected with the hearing device. Correspondingly the hearing device could adapt the acoustic adjustments or alert the hearing device user.

As already mentioned above for the optimisation for the fitting of a hearing device and the ear piece to the user and for the process of acoustic fitting it may be of advantage not only to store geometric data of the shell of the ear canal, the ear piece and the hearing device but also to store other parameter data of a certain importance in connection with the fitting process of the ear piece and the hearing device. As important parameters and information at least one of the following geometry data should be stored:

- cross section area, shape of cross section and length of vent geometry,
- vent microphone distance, microphone positions,
- location of hearing device and distance between hearing device and ear piece,
- average ear canal cross section
- (estimated) residual volume (between ear piece tip and eardrum), e.g. useful for RECD estimation With such data and the earlier mentioned information and parameters available to the acoustician performing the fitting process, it is possible to obtain a simplified model to achieve a good approximation of the acoustic properties of the customized hearing device and to start the fitting process with nearly optimal parameters, which only need minor modification during the final fitting process. In a further preferred embodiment at least one of the following quantities will be estimated by reading out the appropriate data from the data storage:

- vent loss, reducing of occlusion effect, real ear occluded gain, real ear to coupler difference for low frequency range;
- microphone location effect, beamforming correction for higher frequencies, feedback threshold estimation;
- estimation of residual volume and distance to ear drum;
- real ear to coupler difference for high frequency range;
- open ear gain.

By using the data stored in the data storage as input parameters and information it is possible to estimate the above mentioned quantities for entering into the final fitting process.

It is pointed out that the present invention not only applies to hearing devices such as behind the ear hearing aids, for the compensation or correction of a hearing impairment. The present invention may be applied as well for any hearing device, used to improve communication.

If the storage chip is re-writable information or changes of the acoustic parameter, such as enlargement or diminishments of the vent can be written into the chip and therefore can be given together with the ear piece.

The above mentioned information instead of being written directly on the ear piece or being stored in a chip on the ear piece it is also possible to store those parameters and information on an additional storage means, such as e.g. a card, which can be given together with the ear piece. The information about acoustic parameters can be printed on a small card, which can be given together with the ear piece. On the card information can be written as clear text or can be coded. Furthermore, on the card and the ear piece an identification code could be stored so that belonging of the card to the ear piece can be immediately recognised.

Ear pieces, which are not firmly connected to a hearing device, such as a behind the ear hearing device but are exchangeable, are e.g. ear pieces like SlimTip, cShell, xShell or other types of earmolds. But also domes, external receivers, mini tubes with pretailored length can contain a written information or a storage chip with information, which suggest the acoustic behaviour of the hearing system. As reading devices of a storage chip besides separate prefabricated solution e.g. a wireless programming device, as e.g. an iCube can be used.

In case of smaller distances and low energy consumption of the storage chip wireless hearing devices can be used with an inductive coil as a reading device. Especially if the wireless read-out of a storage chip e.g. arranged at an ear piece using a hearing device is technically possible, interchanged ear pieces can be recognised. In general by using the hearing device the correct ear piece can easily be recognised, if a wireless recognition is possible. It could be even possible that the hearing device could be self adjustable by reading the stored parameters and information on the ear piece.

But in general the great advantage of the present invention is that individual characteristics of an ear piece could easily be recognised and used at the acoustic fitting process, when interconnected to the hearing device and when arranged at the ear of a user person.

What is claimed is:

1. A method of providing information for a fitting process of an individually shaped ear piece of a hearing device characterized by storing information for the fitting process during a manufacturing process of the individually shaped ear piece into a data storage means, the data storage means being arranged at the individually shaped ear piece, the information for the fitting process being at least one of:

- a diameter of a vent within the ear piece,
- a length of the vent,
- design information of an ear canal,
- an acoustic vent mass (AVM),
- a length of a shell of the ear piece,
- a design of the shell of the ear piece,
- a kind of hearing device to be used with the ear piece,
- a kind of receiver used within a hearing system or the ear piece,
- a side of the hearing device or the ear piece (right or left),
- a producer of the hearing device or the ear piece,
- a vent loss,
- a reduction of occlusion effect,
- a real ear occluded gain, a real ear to coupler difference for low frequency range,
a microphone location effect, beamforming correction,
an estimation of residual volume and distance to ear drum,
a real ear to coupler difference for high frequency range,
an estimation of feedback threshold, or
an open ear gain.

2. The method according to claim 1, characterized in that the information is applied directly on the ear piece as a laser print, as engraving, as a one-dimensional or two-dimensional barcode, or as a label-print.

3. The method according to claim 1, characterized in that the information is stored in a data chip, which is arranged on the ear piece.

4. The method according to claim 1, characterized in that the storing or reading of the information is accomplished inductively, by using radio frequency.

5. The method according to claim 1, characterized in that the information is coded and can be decoded by means of a fitting software.

6. The method according to claim 1, characterized in that the information is attached to the ear piece as a radio frequency identification (RFID) label.

7. An individually shaped ear piece for a hearing device provided with information for a fitting process according to claim 1 containing a code or a storage means with information being representative for at least one of the following information:

a diameter of a vent within the ear piece,
a length of a vent,
design information of an ear canal,
an acoustic vent mass (AVM),
a length of a shell of the ear piece,
a design of the shell of the ear piece,
a kind of the hearing device to be used with the ear piece,
a kind of a receiver used within a hearing system or the ear piece,
a side of the hearing device or the ear piece (right or left)
a producer of the hearing device or the ear piece,
a vent loss,
a reduction of occlusion effect,
a real ear occluded gain,
a real ear to coupler difference for a low frequency range,
a microphone location effect, beamforming correction,
an estimation of residual volume and distance to an ear drum,
a real ear to coupler difference for high frequency range,
an estimation of feedback threshold, or
an open ear gain.

8. The ear piece according to claim 7, characterized in that the information is applied directly on the ear piece as a laser print, as engraving, as a barcode, or as a label-print.

9. The ear piece according to claim 7, characterized in that a chip is arranged on or in the ear piece.

10. The ear piece according to claim 7, characterized in that the information is arranged on a storage means such as a storage chip or a small card.

11. The ear piece according to claim 7, characterized in that the information being stored at the ear piece is readable by wireless transmission such as by radio frequency or by induction.

12. A hearing system comprising the hearing device and/or the ear piece according to claim 7, characterized in that the hearing device containing an inductive coil being usable as a reading device for the recognition of information being stored at the ear piece.

13. The ear piece according to claim 7, characterized in that the information is applied directly on the ear piece as a RFID label.

* * * * *